US008581657B2

(12) United States Patent
Itoh

(10) Patent No.: US 8,581,657 B2
(45) Date of Patent: Nov. 12, 2013

(54) VOLTAGE DIVIDER, CONSTANT VOLTAGE CIRCUIT USING SAME, AND TRIMMING METHOD IN THE VOLTAGE DIVIDER CIRCUIT

(75) Inventor: Kohzoh Itoh, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 799 days.

(21) Appl. No.: 11/919,057

(22) PCT Filed: Feb. 21, 2007

(86) PCT No.: PCT/JP2007/053708

§ 371 (c)(1),
(2), (4) Date: Oct. 23, 2007

(87) PCT Pub. No.: WO2007/099980

PCT Pub. Date: Sep. 7, 2007

(65) Prior Publication Data

US 2009/0295462 A1 Dec. 3, 2009

(30) Foreign Application Priority Data

Mar. 3, 2006 (JP) ..... 2006-057670

(51) Int. Cl.
*G05F 1/10* (2006.01)

(52) U.S. Cl.
USPC ..... 327/525; 327/538; 327/543

(58) Field of Classification Search
USPC ..... 327/530, 538, 540–543, 525
See application file for complete search history.

(56) References Cited

U.S. PATENT DOCUMENTS 6,232,823 B1 5/2001 Tsuchida et al.
6,809,576 B1 * 10/2004 Yamasaki ..... 327/540

FOREIGN PATENT DOCUMENTS

| | | | |
|---|---|---|---|
| JP | 3-172906 | | 7/1991 |
| JP | 2639328 | * | 6/1995 |
| JP | 2639328 | | 4/1997 |
| JP | 2001-77310 | | 3/2001 |
| JP | 2003-37179 | | 2/2003 |
| JP | 2004-146548 | | 5/2004 |
| JP | 2004-165444 | | 6/2004 |
| JP | 2004-273103 | | 9/2004 |
| JP | 2006-209327 | | 8/2006 |

* cited by examiner

*Primary Examiner* — Long Nguyen
(74) *Attorney, Agent, or Firm* — Dickstein Shapiro LLP

(57) ABSTRACT

A voltage divider circuit generating a divided voltage by dividing an input voltage with a predetermined voltage division ratio, and outputting the divided voltage is disclosed. The voltage divider circuit includes a first resistor circuit including multiple resistors connected in series, the resistors being connected in parallel to corresponding fuses; and a second resistor circuit including multiple resistors connected in series, the resistors being connected in parallel to corresponding fuses, the second resistor circuit being connected in series to the first resistor circuit. The divided voltage is output from the connection of the first resistor circuit and the second resistor circuit, and the fuses of the first resistor circuit and the second resistor circuit are subjected to trimming so that the combined resistance of the first resistor circuit and the second resistor circuit is constant.

8 Claims, 7 Drawing Sheets

PRIOR ART

PRIOR ART

PRIOR ART

FIG.5

| COMBINATION | 1 | 2 | 3 | 4 | 5 | 6 | 7 | 8 |
|---|---|---|---|---|---|---|---|---|
| RA | 0 | K×1 | K×2 | K×3 | K×4 | K×5 | K×6 | K×7 |
| Fa1 | ON | OFF | ON | OFF | ON | OFF | ON | OFF |
| Fa2 | ON | ON | OFF | OFF | ON | ON | OFF | OFF |
| Fa3 | ON | ON | ON | ON | OFF | OFF | OFF | OFF |
| RB | K×7 | K×6 | K×5 | K×4 | K×3 | K×2 | K×1 | 0 |
| Fb1 | OFF | ON | OFF | ON | OFF | ON | OFF | ON |
| Fb2 | OFF | OFF | ON | ON | OFF | OFF | ON | ON |
| Fb3 | OFF | OFF | OFF | OFF | ON | ON | ON | ON |

VOLTAGE DIVIDER, CONSTANT VOLTAGE CIRCUIT USING SAME, AND TRIMMING METHOD IN THE VOLTAGE DIVIDER CIRCUIT

TECHNICAL FIELD

The present invention relates to a voltage divider circuit in a semiconductor device, a constant voltage circuit that uses the voltage divider circuit and is capable of varying output voltage, a voltage detector circuit that uses the voltage divider circuit and is capable of varying voltage to be detected, and a trimming method in the voltage divider circuit.

BACKGROUND ART

There are variations in the characteristics of various circuit elements formed on semiconductor integrated circuits because of variations in manufacturing processes. The variations in the characteristics of the circuit elements cause variations in the characteristics of entire circuits. If the circuit characteristics do not meet specifications, it is necessary to adjust the circuit characteristics by providing an adjuster circuit, for which adjustment resistor trimming is commonly employed.

FIG. 1 is a diagram showing a circuit that adjusts the output voltage Vout of a constant voltage circuit by trimming.

The constant voltage circuit of FIG. 1 includes a reference voltage generator circuit 101 that generates and outputs a predetermined reference voltage Vref, an error amplifier circuit 102, an output transistor M101, and resistors R101 and R102 for output voltage detection. The constant voltage circuit further includes adjusting resistors Rt1 through Rt4 for output voltage adjustment and fuses F101 through F105.

The error amplifier circuit 102 controls the gate voltage of the output transistor M101 so that a divided voltage Vfb generated by dividing the output voltage Vout with the resistors R101, Rt1 through Rt4, and R102 is equal to the reference voltage Vref.

The output voltage Vout before trimming of the fuses F101 through F105 is expressed as Vref×(R101+R102)/R102. In the semiconductor device, the variation of the resistance ratio is small. However, the reference voltage Vref varies within a range of several to tens of % depending on a circuit configuration. Since the output voltage Vout is proportional to the reference voltage Vref, the output voltage Vout also varies.

Therefore, in the constant voltage circuit of FIG. 1, the output voltage Vout before trimming is measured so as to select one of the fuses F101 through F105 which one is not to be cut and is to be left based on the difference between the measured output voltage Vout and a target output voltage, and cut the other fuses. Thereby, it is possible to approximate the output voltage Vout after trimming to the target output voltage. The resistance connected between the resistor R101 and the resistor R102 is the sum of the resistances of the adjusting resistors Rt1 through Rt4, and is constant. irrespective of the trimming condition.

The adjusting resistors Rt1 through Rt4 used in the adjusting circuit shown in FIG. 1 generally have the same resistance, and the number of resistors for output voltage adjustment increases or decreases depending on the range of adjustment and the minimum adjusted value of the output voltage Vout. Therefore, if the range of adjustment is wide and fine adjustment is required, many resistors and fuses are necessary. Therefore, a method for reducing the number of fuses has been developed. (For example, see Japanese Laid-Open Patent Application No. 3-172906.)

FIG. 2 is a circuit diagram showing another conventional constant voltage circuit. In FIG. 2, the same elements as or the elements similar to those of FIG. 1 are referred to by the same reference numerals.

The constant voltage circuit of FIG. 2 is different from that of FIG. 1 in that the fuses F101 through F104 are connected in parallel to the adjusting resistors Rt1 through Rt4. By weighting the resistance of the adjusting resistors Rt1 and Rt2 and the resistance of the adjusting resistors Rt3 and Rt4, it is possible to reduce the number of adjusting resistors and trimming fuses. There is a reference voltage generator circuit using such a method. (For example, see Japanese Patent No. 2639328.)

Further, there is a circuit that reduces the number of adjusting resistors and trimming fuses by disposing a resistor and series circuits each of an adjusting resistor and a trimming fuse in an H shape. (For example, see Japanese Laid-Open Patent Application No. 2001-77310.)

On the other hand, some constant voltage circuits have a variable resistor circuit 112 made in part of output voltage detecting resistors as shown in FIG. 3. (For example, see Japanese Laid-Open Patent Application No. 2004-273103.)

Referring to FIG. 3, the variable resistor circuit 112 includes multiple resistors Rs1 through Rs4 connected in series, switches SW1 through SW4 connected in parallel to the resistors Rs1 through Rs4, respectively, and a selector 113 that performs on-off control on the switches SW1 through SW4 in accordance with an externally input voltage setting signal Sa. In the constant voltage circuit of FIG. 3, the output voltage Vout is changed by varying the resistance of the variable resistor circuit 112. In the constant voltage circuit of FIG. 3, 16 output voltages can be set by performing binary number weighting on the resistors Rs1 through Rs4.

However, the adjusting circuit shown in FIG. 1 has a problem in that a finer unit of adjustment results in an increase in the number of adjusting resistors and fuses. For example, in order to set the range of adjustment with 256-level accuracy, 255 adjusting resistors and 256 fuses are required. The number of fuses can be reduced to eight by employing a method for reducing the number of fuses. However, the number of adjusting resistors cannot be reduced, and in return for a decrease in the number of fuses, as many (256) switching elements as the conventional fuses and a decoder for performing on-off control on each switching element are required, thus causing a problem in that the circuit is extremely large in size.

On the other hand, in the adjusting circuit shown in FIG. 2, the number of resistors and fuses can be significantly reduced by weighting the resistances of the adjusting resistors. In the case of setting the range of adjustment with 256-level accuracy as in the case of FIG. 1, the total number of adjusting resistors and fuses required is 14, that is, seven on each of the upper side and the lower side of the connection part that outputs the divided voltage Vfb. However, this causes a problem in that the combined resistance of the adjusting circuit changes in accordance with the contents of trimming.

Further, in the case of adjusting the output voltage Vout of the constant voltage circuit of FIG. 3 by adding an adjusting circuit whose combined resistance changes in accordance with the contents of trimming as shown in FIG. 2, the current that flows through the resistors for output voltage detection after trimming changes in value in accordance with the trimming result. That is, since the voltage drop in each of the resistors Rs1 through Rs4 for output voltage changing varies, there is a problem in that inputting the same voltage setting signal does not result in the same output voltage Vout depending on the trimming result.

The output voltage Vout may be adjusted by adjusting the reference voltage Vref instead of performing trimming on the resistors for output voltage detection. However, this requires the reference voltage generator circuit itself to be a constant voltage circuit with the same adjusting circuit as shown in FIG. 1 or 2, thus causing an increase in circuit size and in current consumption as well. Further, reducing the number of stages of amplification by an error amplifier circuit in the reference voltage generator circuit in order to suppress an increase in circuit size causes problems such as deterioration of AC characteristics and an increase in ripple.

In the case of using the adjusting circuit shown in FIG. 1 in the constant voltage circuit of FIG. 3, the combined resistance of the resistors for output voltage detection remains the same even after trimming is performed. As described above, however, the adjusting circuit itself is large in circuit size. Accordingly, there is still the problem of an increase in circuit size.

Further, the resistance after trimming also changes in a circuit that reduces the number of adjusting resistors and trimming fuses by disposing a resistor and series circuits each of an adjusting resistor and a trimming fuse in an H shape, so that the same problem as in the case of FIG. 2 occurs. The same problem also occurs in a voltage detector circuit that divides input voltage with resistors and compares the divided voltage with a reference voltage.

DISCLOSURE OF THE INVENTION

Embodiments of the present invention may solve or reduce one or more of the above-described problems.

According to one embodiment of the present invention, there is provided a voltage divider circuit in which one or more of the above-described problems may be solved or reduced.

According to one embodiment of the present invention, there is provided a voltage divider circuit capable of reducing the number of adjusting resistors and fuses without changing combined resistance after trimming, a constant voltage circuit and a voltage detector circuit using the voltage divider circuit, and a trimming method in the voltage divider circuit.

According to one embodiment of the present invention, there is provided a voltage divider circuit generating a divided voltage by dividing an input voltage with a predetermined voltage division ratio, and outputting the divided voltage, the voltage divider circuit including a first resistor circuit including a plurality of resistors connected in series, the resistors being connected in parallel to corresponding fuses; and a second resistor circuit including a plurality of resistors connected in series, the resistors being connected in parallel to corresponding fuses, the second resistor circuit being connected in series to the first resistor circuit, wherein the divided voltage is output from a connection of the first resistor circuit and the second resistor circuit, and the fuses of the first resistor circuit and the second resistor circuit are subjected to trimming so that a combined resistance of the first resistor circuit and the second resistor circuit is constant.

According to one embodiment of the present invention, there is provided a constant voltage circuit capable of varying an output voltage, the constant voltage circuit including a voltage divider circuit configured to generate a divided voltage by dividing the output voltage with a predetermined voltage division ratio and to output the divided voltage in order to detect the output voltage, the voltage divider circuit including a first resistor circuit including a plurality of resistors connected in series, the resistors being connected in parallel to corresponding fuses; and a second resistor circuit including a plurality of resistors connected in series, the resistors being connected in parallel to corresponding fuses, the second resistor circuit being connected in series to the first resistor circuit, wherein the divided voltage is output from a connection of the first resistor circuit and the second resistor circuit, and the fuses of the first resistor circuit and the second resistor circuit are subjected to trimming so that a combined resistance of the first resistor circuit and the second resistor circuit is constant.

According to one embodiment of the present invention, there is provided a voltage detector circuit capable of varying a detection level of an input voltage, the voltage detector circuit determining whether a divided voltage of the input voltage reaches a predetermined voltage, the voltage detector circuit including a voltage divider circuit configured to generate the divided voltage by dividing the input voltage with a predetermined voltage division ratio and to output the divided voltage in order to detect the input voltage, the voltage divider circuit including a first resistor circuit including a plurality of resistors connected in series, the resistors being connected in parallel to corresponding fuses; and a second resistor circuit including a plurality of resistors connected in series, the resistors being connected in parallel to corresponding fuses, the second resistor circuit being connected in series to the first resistor circuit, wherein the divided voltage is output from a connection of the first resistor circuit and the second resistor circuit, and the fuses of the first resistor circuit and the second resistor circuit are subjected to trimming so that a combined resistance of the first resistor circuit and the second resistor circuit is constant.

According to one embodiment of the present invention, there is provided a trimming method in a voltage divider circuit, the voltage divider circuit including a first resistor circuit including a plurality of resistors connected in series, the resistors being connected in parallel to corresponding fuses; and a second resistor circuit including a plurality of resistors connected in series, the resistors being connected in parallel to corresponding fuses, the second resistor circuit being connected in series to the first resistor circuit, the voltage divider circuit dividing an input voltage with the first resistor circuit and the second resistor circuit and outputting a divided voltage generated by dividing the input voltage, wherein the fuses of the first resistor circuit and the second resistor circuit are subjected to trimming so that a combined resistance of the first resistor circuit and the second resistor circuit is constant.

According to a voltage divider circuit, a constant voltage circuit and a voltage detector circuit using the voltage divider circuit, and a trimming method in the voltage divider circuit according to embodiments of the present invention, the combined resistance of a first resistor circuit and a second resistor circuit after trimming can always be constant, and the number of adjusting resistors and fuses required can be significantly smaller than conventionally.

Further, in a circuit that sets or determines voltage by varying resistance, a voltage drop by the resistance does not change. Accordingly, as long as the externally input voltage setting signal is the same, the output voltage or the detected voltage (the detection level of voltage) can be the same in a constant voltage circuit or a voltage detector circuit of any IC. Further, there is no need to perform voltage adjustment or trimming at the time of generating a reference voltage. Therefore, a simple circuit configuration can be employed for the circuit that generates the reference voltage. Accordingly, it is possible to realize a constant voltage circuit of a variable output voltage type and a voltage detector circuit of a variable detected voltage type that are reduced in circuit size and current consumption and excellent in ripple and AC characteristics.

BRIEF DESCRIPTION OF THE DRAWINGS

Other objects, features and advantages of the present invention will become more apparent from the following detailed description when read in conjunction with the accompanying drawings, in which:

FIG. 5 is a table showing how fuses are cut and the combinations of the resistance of a first resistor circuit and the resistance of a second resistor circuit 3 according to the embodiment of the present invention;

BEST MODE FOR CARRYING OUT THE INVENTION

A description is given, with reference to the accompanying drawings, of an embodiment of the present invention.

Figure 4:
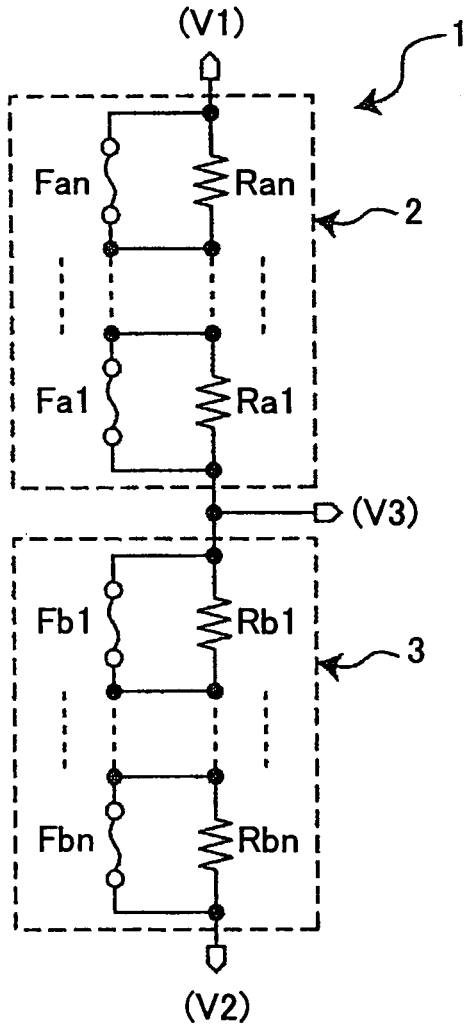
FIG. 4 is a diagram showing a voltage divider circuit according to an embodiment of the present invention.

FIG. 4 is a diagram showing a voltage divider circuit 1 according to the embodiment of the present invention.

Referring to FIG. 4, the voltage divider circuit 1 includes a first resistor circuit 2 and a second resistor circuit 3 connected in series between a voltage V1 and a voltage V2. The voltage divider circuit 1 outputs a voltage V3 from the connection of the first resistor circuit 2 and the second resistor circuit 3.

Further, the first resistor circuit 2 includes adjusting resistors Ra1 through Ran and fuses Fa1 through Fan, and the second resistor circuit 3 includes adjusting resistors Rb1 through Rbn and fuses Fb1 through Fbn, where n is an integer greater than one (n>1). The first resistor circuit 2 and the second resistor circuit 3 have the same circuit configuration.

In the first resistor circuit 2, the adjusting resistors Ra1 through Ran are connected in series between the voltage V1 and the voltage V3, and the fuses Fa1 through Fan are connected in parallel to the adjusting resistors Ra1 through Ran, respectively. In the second resistor circuit 3, the adjusting resistors Rb1 through Rbn are connected in series between the voltage V3 and the voltage V2, and the fuses Fb1 through Fbn are connected in parallel to the adjusting resistors Rb1 through Rbn, respectively.

In this configuration, the resistance of each of the adjusting resistors Ra1 through Ran and the adjusting resistors Rb1 through Rbn is subjected to binary code weighting. For example, letting the resistance of the adjusting resistor Ra1 be K, the resistance of an adjusting resistor Rai (i=1 to n) is $K\times2^{i-1}$. Likewise, the adjusting resistor Rb1 has the same resistance K as the adjusting resistor Ra1, and the resistance of an adjusting resistor Rbi (i=1 to n) is $K\times2^{i-1}$. Here, n indicates the number of bits for obtaining required adjustment accuracy.

In the case of indicating, with a binary number, whether to cut each of the fuses Fa1 through Fan of the first resistor circuit 2 and the fuses Fb1 through Fbn of the second resistor circuit 3 by trimming, for example, letting the case of not performing cutting be binary "0" and letting the case of performing cutting be binary "1," trimming may be performed on each of the fuses Fb1 through Fbn of the second resistor circuit 3 so that the binary data indicating the status of cutting of each of the fuses Fb1 through Fbn of the second resistor circuit 3 are the one's complement of the binary data indicating the status of cutting of each of the fuses Fa1 through Fan of the first resistor circuit 2 and that the combined resistance of the first resistor circuit 2 and the second resistor circuit 3 is $K\times(2^n-1)$.

FIG. 5 is a table showing how the fuses Fa1 through Fan and Fb1 through Fbn are cut and the combinations of the resistance RA of the first resistor circuit 2 and the resistance RB of the second resistor circuit 3 in the case of n=3. In the table of FIG. 5, to cut a fuse is indicated as OFF and not to cut a fuse is indicated as ON. A description is given, with reference to FIG. 5, of a method of trimming the fuses Fa1 through Fan and Fb1 through Fbn, taking the case of n=3, that is, a three-bit configuration, as an example.

The resistance of each of the adjusting resistors Ra1 through Ran and the resistance of each of the adjusting resistors Rb1 through Rbn are subjected to binary code weighting. Letting the resistance of each of the adjusting resistors Ra1 and Rb1 be K, the resistance of each of the adjusting resistors Ra2 and Rb2 is K×2, and the resistance of each of the adjusting resistors Ra3 and Rb3 is K×4.

Trimming is performed on the fuses Fa1 through Fa3 and Fb1 through Fb3 so that the combined resistance of the first resistor circuit 2 and the second resistor circuit 3 is $K\times(2^3-1)=K\times7$. For example, in the case of cutting none of the fuses Fa1 through Fa3 of the first resistor circuit 2, all of the fuses Fb1 through Fb3 of the second resistor circuit 3 are cut. As a result, while the combined resistance of the first resistor circuit 2 is zero, the combined resistance of the second resistor circuit 3 is K×7. In the case of cutting only the fuse Fa2 in the first resistor circuit 2, the fuses Fb1 and Fb3 of the second resistor circuit 3 are cut. As a result, the combined resistance of the first resistor circuit 2 is K×2, and the combined resistance of the second resistor circuit 3 is K×5. In each case, the combined resistance of the first resistor circuit 2 and the second resistor circuit 3 is K×7. As shown in FIG. 5, there are two cubed, that is, eight combinations of fuses to be cut in the first resistor circuit 2 and the second resistor circuit 3.

Figure 1:
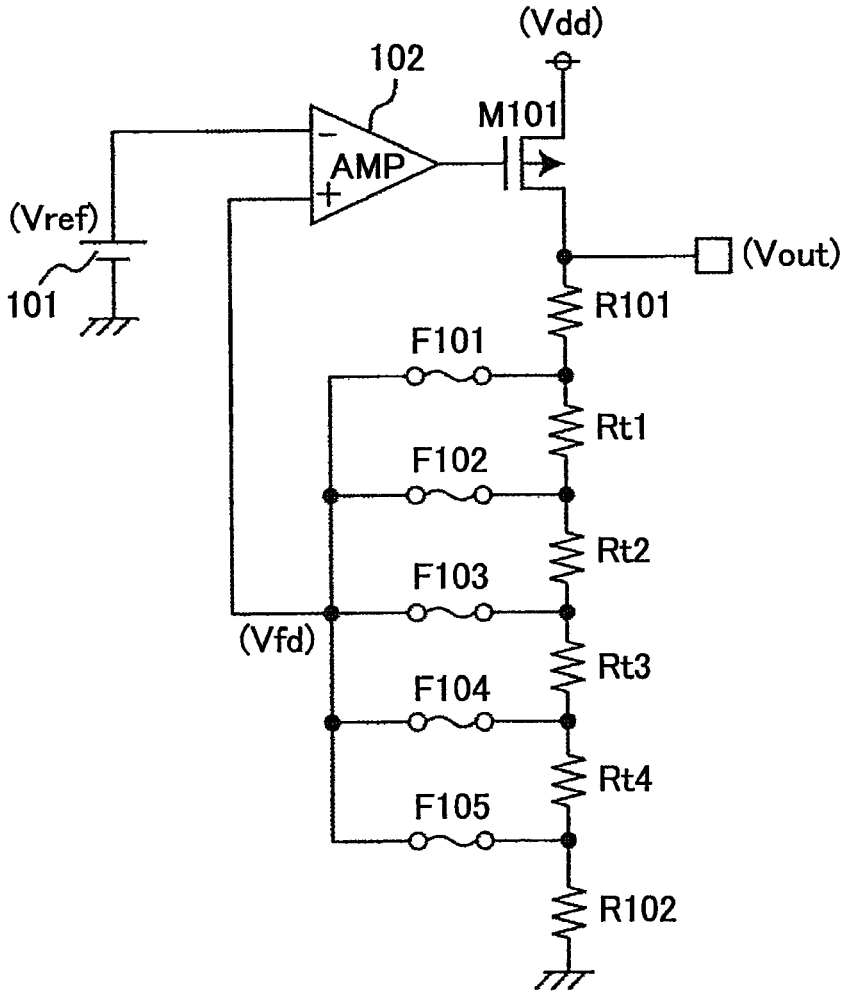
FIG. 1 is a diagram showing a conventional constant voltage circuit.
Figure 2:
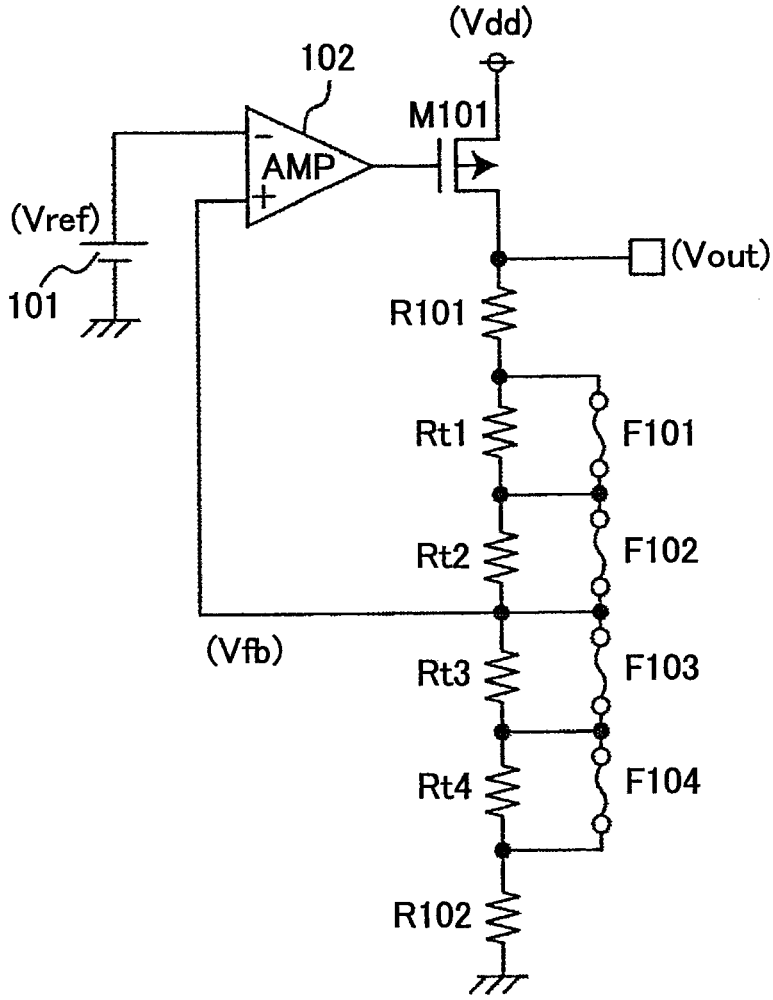
FIG. 2 is a diagram showing another conventional constant voltage circuit.
Figure 3:
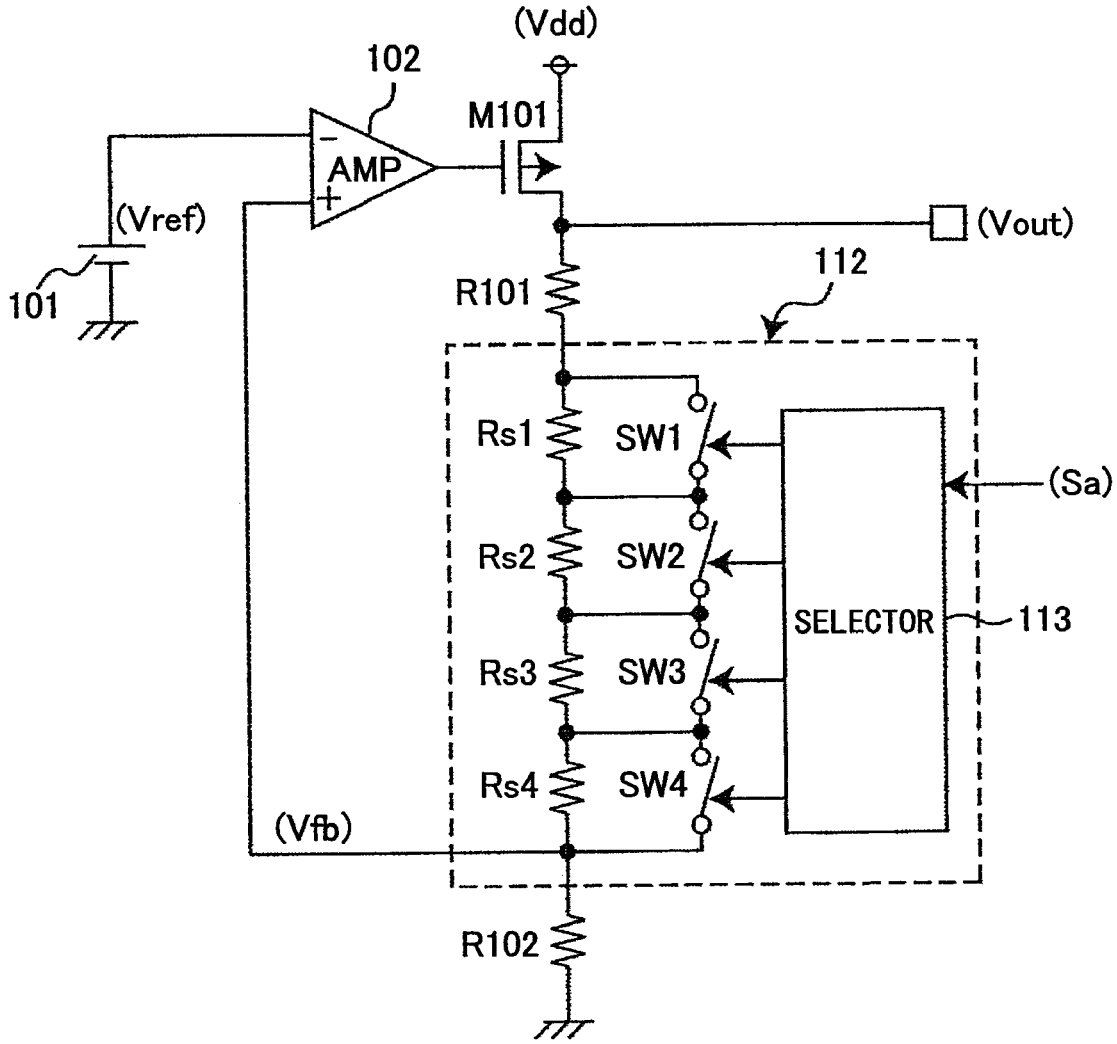
FIG. 3 is a diagram showing yet another conventional constant voltage circuit.

As a result, the combined resistance of the first resistor circuit 2 and the second resistor circuit 3 after trimming can always be constant. Further, in a configuration of three or more bits where n≥3, the number of adjusting resistors can be reduced compared with the conventional case of FIG. 1. This effect becomes greater as the number of bits increases. For example, in the case of eight bits, 256 adjusting resistors and 257 fuses are required in the conventional case of FIG. 1 while. 16 adjusting resistors and 16 fuses are employed in the voltage divider circuit 1 according to this embodiment. Thus, the number of adjusting resistors and fuses required can be significantly smaller in the voltage divider circuit 1 of this embodiment than conventionally without changing the combined resistance after trimming.

Thus, according to one aspect of the present invention, there is provided a voltage divider circuit generating a divided voltage by dividing an input voltage with a predetermined voltage division ratio, and outputting the divided voltage, the voltage divider circuit including a first resistor circuit including multiple resistors connected in series, the resistors being connected in parallel to corresponding fuses; and a second resistor circuit including multiple resistors connected in series, the resistors being connected in parallel to corresponding fuses, the second resistor circuit being connected in series to the first resistor circuit, wherein the divided voltage is output from the connection of the first resistor circuit and the second resistor circuit, and the fuses of the first resistor circuit and the second resistor circuit are subjected to trimming so that the combined resistance of the first resistor circuit and the second resistor circuit is constant.

Further, according to one aspect of the present invention, there is provided a trimming method in a voltage divider circuit, the voltage divider circuit including a first resistor circuit including multiple resistors connected in series, the resistors being connected in parallel to corresponding fuses; and a second resistor circuit including multiple resistors connected in series, the resistors being connected in parallel to corresponding fuses, the second resistor circuit being connected in series to the first resistor circuit, the voltage divider circuit dividing an input voltage with the first resistor circuit and the second resistor circuit and outputting a divided voltage generated by dividing the input voltage, wherein the fuses of the first resistor circuit and the second resistor circuit are subjected to trimming so that the combined resistance of the first resistor circuit and the second resistor circuit is constant.

Figure 6:
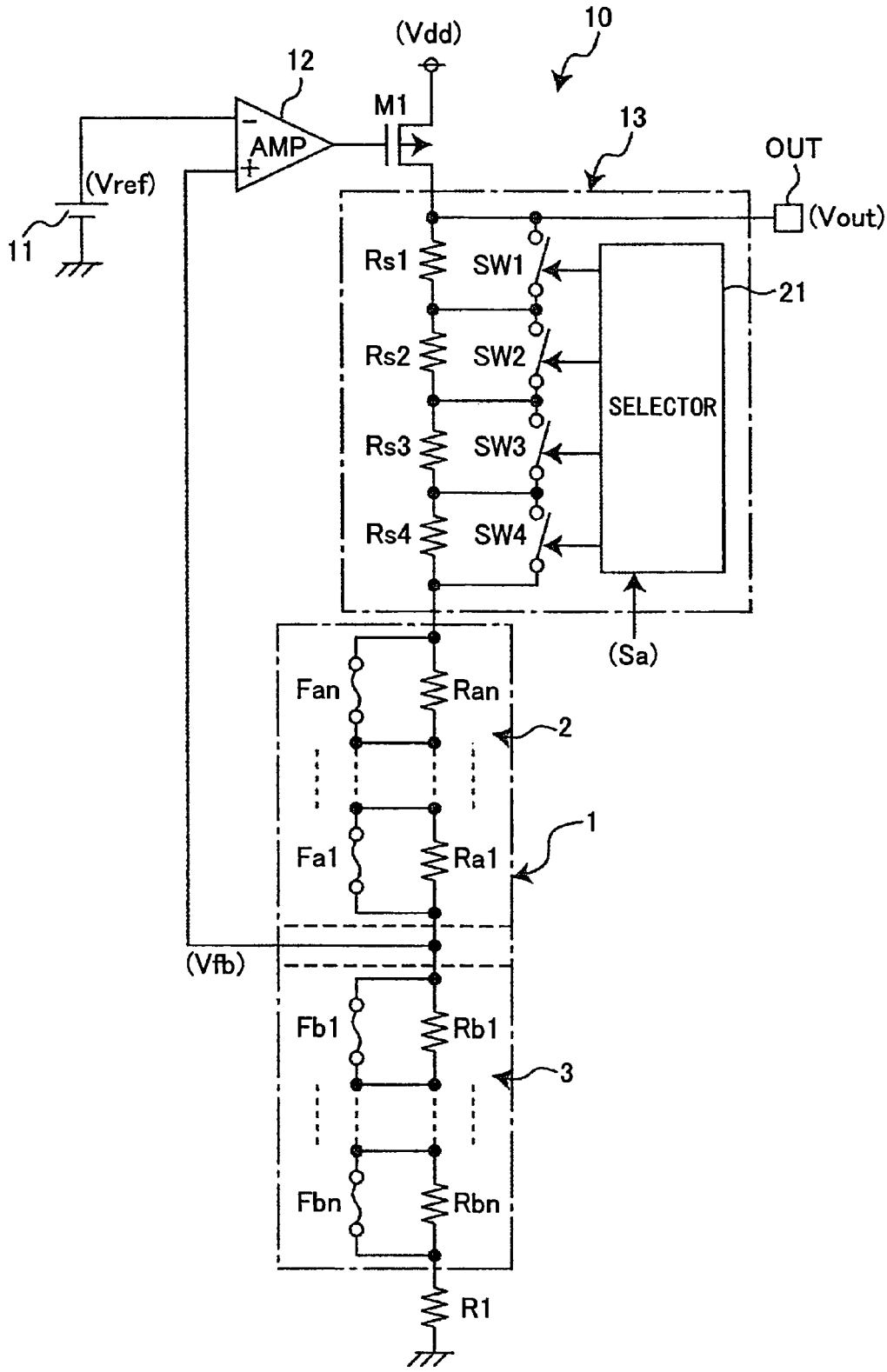
FIG. 6 is a diagram showing a constant voltage circuit including the voltage divider circuit 1 of FIG. 4 according to the embodiment of the present invention.

Next, FIG. 6 is a diagram showing a constant voltage circuit 10 including the voltage divider. circuit 1 of FIG. 4. FIG. 6 shows the case of application to a series regulator.

Referring to FIG. 6, the constant voltage circuit 10 converts a supply voltage Vdd input as an input voltage into a predetermined voltage, and outputs the predetermined voltage from an output terminal OUT.

The constant voltage circuit 10 includes a reference voltage generator circuit 11 that generates and outputs a predetermined reference voltage Vref, an error amplifier circuit 12, an output transistor M1 formed of a PMOS transistor, a variable resistor circuit 13 whose resistance varies in accordance with an externally input voltage setting signal Sa, and the voltage divider circuit 1. The variable resistor circuit 13 includes resistors Rs1 through Rs4, switches SW1 through SW4, and a selector 21.

The output transistor M1 is connected between the supply voltage Vdd that is an input voltage and the output terminal OUT. The variable resistor circuit 13, the voltage divider circuit 1, and a resistor R1 are connected in series between the output terminal OUT and ground. A divided voltage Vfb, which is the voltage V3 (FIG. 4) at the connection of the first resistor circuit 2 and the second resistor circuit 3, is input to the non-inverting input of the error amplifier circuit 12. The reference voltage Vref is input to the inverting input of the error amplifier circuit 12. The output of the error amplifier circuit 12 is connected to the gate of the output transistor M1. The error amplifier circuit 12 controls the operation of the output transistor M1 so that the divided voltage Vfb is equal to the reference voltage Vref, thereby controlling the output current of the output transistor M1.

The resistors Rs1 through Rs4 are connected in series between the drain of the output transistor M1 and the voltage divider circuit 1. The switches SW1 through SW4 are connected in parallel to the resistors Rs1 through Rs4, respectively. The selector 21 controls switching of the switches SW1 through SW4 in accordance with the input voltage setting signal Sa. The resistors Rs1 through Rs4 are weighted according to a binary code, so that the variable resistor circuit 13 has 16 resistances in accordance with the voltage setting signal Sa. The voltage divider circuit 1 has the same configuration as shown in FIG. 5.

In this configuration, the switches SW1 through SW4 are caused to turn OFF to be open by the voltage setting signal Sa, and the output voltage Vout at this point is measured. The ratio of the combined resistance of the first resistor circuit 2 to the combined resistance of the second resistor circuit 3 is calculated from the difference between the measured output. voltage Vout and a target voltage at the time of switching OFF all the switches SW1 through SW4, thereby determining fuses to be cut in the first resistor circuit 2 and the second resistor circuit 3. Since the resistance of the voltage divider circuit 1 after trimming is $K\times(2^n-1)$, where K is the resistance of each of the resistor Ra1 and Rb1, the resistance of the voltage divider circuit 1 after trimming is constant irrespective of the resistance ratio of the first resistor circuit 2 and the second resistor circuit 3, so that a voltage drop in the variable resistor circuit 13 is always constant regardless of the contents of the trimming. Therefore, a voltage change per bit of the variable resistor circuit 13 is constant. That is, as long as the voltage setting signal Sa remains the same, the constant voltage circuit 10 can output the same voltage.

Thus, according to one aspect of the present invention, there is provided a constant voltage circuit capable of varying an output voltage, the constant voltage circuit including a voltage divider circuit configured to generate a divided voltage by dividing the output voltage with a predetermined voltage division ratio and to output the divided voltage in order to detect the output voltage, the voltage divider circuit including a first resistor circuit including multiple resistors connected in series, the resistors being connected in parallel to corresponding fuses; and a second resistor circuit including multiple resistors connected in series, the resistors being connected in parallel to corresponding fuses, the second resistor circuit being connected in series to the first resistor circuit, wherein the divided voltage is output from the connection of the first resistor circuit and the second resistor circuit, and the fuses of the first resistor circuit and the second resistor circuit are subjected to trimming so that the combined resistance of the first resistor circuit and the second resistor circuit is constant.

Figure 7:
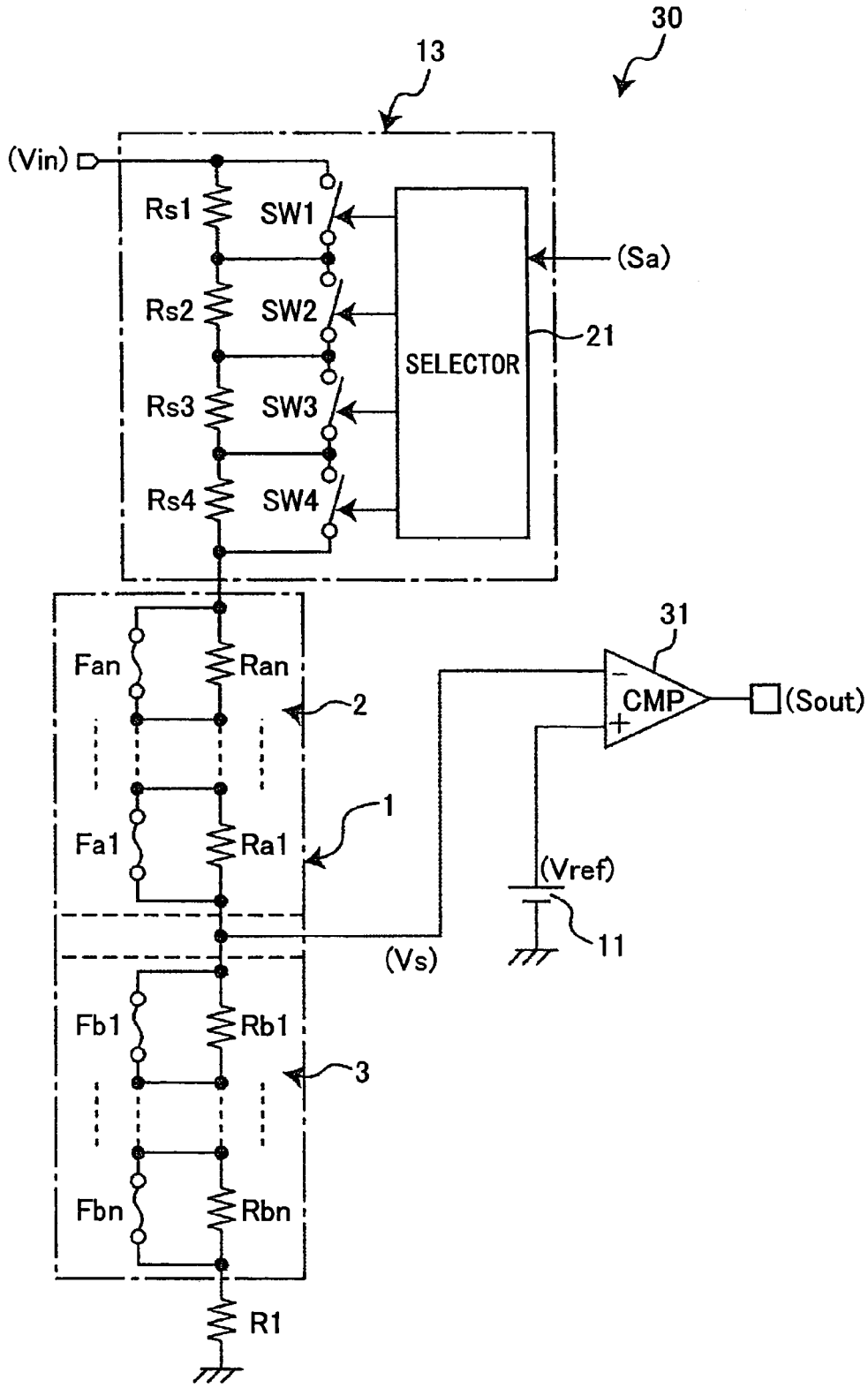
FIG. 7 is a diagram showing a voltage detector circuit including the voltage divider circuit 1 of FIG. 4 according to the embodiment of the present invention.

Next, FIG. 7 is a diagram showing a voltage detector circuit 30 including the voltage divider circuit 1 of FIG. 4. In FIG. 7, the same elements as or the elements similar to those of FIG. 6 are referred to by the same reference numerals.

Referring to FIG. 7, the voltage detector circuit 30 determines whether an input voltage Vin is greater than or equal to, or less than a predetermined voltage. Specifically, the voltage detector circuit 30 compares a divided voltage Vs obtained by dividing the input voltage Vin with a predetermined reference voltage Vref, and outputs a binary signal Sout that indicates the comparison result.

The voltage detector circuit 30 includes the reference voltage generator circuit 11 that generates and outputs the predetermined reference voltage Vref, a comparator 31, the variable resistor circuit 13, and the voltage divider circuit 1.

The variable resistor circuit 13, the voltage divider circuit 1, and the resistor R1 are connected in series between the input voltage Vin and ground. The divided voltage Vs, which is the voltage V3 (FIG. 4) at the connection of the first resistor circuit 2 and the second resistor circuit 3, is input to the inverting input of the comparator 31. The reference voltage Vref is input to the non-inverting input of the comparator 31, and the binary signal Sout is output from the output of the comparator 31.

The variable resistor circuit 13 is the same as shown in FIG. 6. The resistance of the variable resistor circuit 13 changes in accordance with the condition of the switches SW1 through SW4, which are subjected to on-off switching control by the selector 21 in accordance with the voltage setting signal Sa. A change in the resistance of the variable resistor circuit 13 changes the divided voltage Vs, thereby making it possible to change the level of a detected voltage.

In the voltage detector circuit 30 of FIG. 7, a variation in the reference voltage Vref also causes the detected voltage to go wrong. Therefore, the voltage divider circuit 1 is provided so as to correct the variation in the reference voltage Vref.

Employment of the voltage divider circuit 1 of FIG. 4 causes a voltage drop of the variable resistor circuit 13 to remain the same even after trimming. Accordingly, as long as the voltage setting signal Sa is the same, the detected voltage can be the same in the voltage detector circuit 30.

Thus, according to one aspect of the present invention, there is provided a voltage detector circuit capable of varying a detection level of an input voltage, the voltage detector circuit determining whether a divided voltage of the input voltage reaches a predetermined voltage, the voltage detector circuit including a voltage divider circuit configured to generate the divided voltage by dividing the input voltage with a predetermined voltage division ratio and to output the divided voltage in order to detect the input voltage, the voltage divider circuit including a first resistor circuit including multiple resistors connected in series, the resistors being connected in parallel to corresponding fuses; and a second resistor circuit including multiple resistors connected in series, the resistors being connected in parallel to corresponding fuses, the second resistor circuit being connected in series to the first resistor circuit, wherein the divided voltage is output from the connection of the first resistor circuit and the second resistor circuit, and the fuses of the first resistor circuit and the second resistor circuit are subjected to trimming so that the combined resistance of the first resistor circuit and the second resistor circuit is constant.

Thus, according to the voltage divider circuit 1 of this embodiment, the combined resistance of the first resistor circuit 2 and the second resistor circuit 3 after trimming is always constant, and the number of adjusting resistors and fuses required can be significantly smaller than conventionally. Accordingly, in a circuit that sets or determines voltage by varying resistance, a voltage drop by the resistance does not change. Accordingly, as long as the externally input voltage setting signal is the same, the output voltage or the detected voltage can be the same in a constant voltage circuit or a voltage detector circuit of any IC.

Further, there is no need to perform voltage adjustment or trimming at the time of generating the reference voltage Vref. Therefore, a simple circuit configuration can be employed for the circuit that generates the reference voltage Vref. Accordingly, it is possible to realize a constant voltage circuit of a variable output voltage type and a voltage detector circuit of a variable detected voltage type that are reduced in circuit size and current consumption and excellent in ripple and AC characteristics.

The present invention is not limited to the specifically disclosed embodiment, and variations and modifications may be made without departing from the scope of the present invention.

The present application is based on Japanese Priority Patent Application No. 2006-057670, filed on Mar. 3, 2006, the entire contents of which are hereby incorporated by reference.

The invention claimed is:

1. A voltage divider circuit generating a divided voltage by dividing an input voltage with a predetermined voltage division ratio, and outputting the divided voltage, the voltage divider circuit comprising:

a first resistor circuit including at least first, second and third resistors and at least first, second and third fuses, all of the resistors included in the first resistor circuit being connected in series and being connected in parallel to corresponding fuses, and all of the fuses being connected in series, and wherein resistances of the first, second and third resistors are K, 2K and 4K, respectively;

a second resistor circuit including at least first, second and third resistors and at least first, second and third fuses, all of the resistors included in the second resistor circuit being connected in series and being connected in parallel to corresponding fuses, and all of the fuses being connected in series, a resistor of the second resistor circuit being directly connected in series to a resistor of the first resistor circuit, and wherein resistances of the first, second and third resistors of the second resistor circuit are K, 2K and 4K, respectively; and a divided voltage output line that outputs the divided voltage from a connection of the first resistor circuit and the second resistor circuit, and the fuses of the first resistor circuit and the second resistor circuit are subjected to trimming so that a combined resistance of the first resistor circuit and the second resistor circuit is $K\times(2^n-1)$, where n is the number of resistors in the first resistor circuit and the second resistor circuit; and wherein the first resistor circuit and the second resistor circuit have a same circuit configuration, and the resistors of the first resistor circuit and the resistors of the second resistor circuit have respective resistances thereof weighted according to a binary code.

2. The voltage divider circuit as claimed in claim 1, wherein the fuses of the first resistor circuit and the fuses of the second resistor circuit are subjected to the trimming so that first binary number data of the first resistor circuit and second binary number data of the second resistor circuit are complements of each other, the first binary number data being obtained by expressing with binary data whether each of the fuses of the first resistor circuit is to be cut by the trimming and the second binary number data being obtained by expressing with binary data whether each of the fuses of the second resistor circuit is to be cut by the trimming.

3. A constant voltage circuit capable of varying an output voltage, the constant voltage circuit comprising:

a voltage divider circuit configured to generate a divided voltage by dividing the output voltage with a predetermined voltage division ratio and to output the divided voltage in order to detect the output voltage, the voltage divider circuit including a first resistor circuit including resistors and fuses, all of the resistors included in the first resistor circuit being connected in series and being connected in parallel to corresponding fuses, and all of the fuses being connected in series;

a second resistor circuit including resistors and fuses, all of the resistors included in the second resistor circuit being connected in series and being connected in parallel to corresponding fuses, and all of the fuses being connected in series, a resistor of the second resistor circuit being directly connected in series to a resistor of the first resistor circuit;

a divided voltage output line that outputs the divided voltage from a connection of the first resistor circuit and the second resistor circuit, and the fuses of the first resistor circuit and the second resistor circuit are subjected to trimming so that a combined resistance of the first resistor circuit and the second resistor circuit is constant; and a variable resistor circuit for determining the output voltage, the variable resistor circuit being connected between the first resistor circuit and the output line and capable of varying a resistance thereof in accordance with an externally input signal, said variable resistor circuit comprising: a plurality of resistors connected in series, and a plurality of switches, each switch being connected in parallel with and associated with a respective resistor of the plurality of resistors within the variable resistor circuit, said switches being switched based on the externally input signal.

4. The constant voltage circuit as claimed in claim 3, wherein the first resistor circuit and the second resistor circuit have a same circuit configuration, and the resistors of the first resistor circuit and the resistors of the second resistor circuit have respective resistances thereof weighted according to a binary code.

5. The constant voltage circuit as claimed in claim 4, wherein the fuses of the first resistor circuit and the fuses of the second resistor circuit are subjected to the trimming so that first binary number data of the first resistor circuit and second binary number data of the second resistor circuit are complements of each other, the first binary number data being obtained by expressing with binary data whether each of the fuses of the first resistor circuit is to be cut by the trimming and the second binary number data being obtained by expressing with binary data whether each of the fuses of the second resistor circuit is to be cut by the trimming.

6. A trimming method, comprising:

providing a voltage divider circuit including:

a first resistor circuit including at least first, second and third resistors and at least first, second and third fuses, all of the resistors included in the first resistor circuit being connected in series and being connected in parallel to corresponding fuses, and all of the fuses being connected in series, and wherein the first, second and third resistors have first, second and third resistances, respectively, and wherein the first, second and third resistances are different from each other;

a second resistor circuit including at least first, second and third resistors and at least first, second and third fuses, all of the resistors included in the second resistor circuit being connected in series and being connected in parallel to corresponding fuses, and all of the fuses being connected in series, a resistor of the second resistor circuit being directly connected in series to a resistor of the first resistor circuit, and wherein the first, second and third resistors of the second resistor circuit have said first, second and third resistances, respectively; and a divided voltage output line that outputs a divided voltage from a connection of the first resistor circuit and the second resistor circuit, the voltage divider circuit dividing an input voltage with the first resistor circuit and the second resistor circuit and outputting the divided voltage on the divided output line; and subsequently, trimming the fuses of the first resistor circuit and the second resistor circuit.

7. The trimming method as claimed in claim 6, wherein the first resistor circuit and the second resistor circuit have a same circuit configuration, and the resistors of the first resistor circuit and the resistors of the second resistor circuit have respective resistances thereof weighted according to a binary code, and wherein said first, second and third resistances are K, 2K and 4K, respectively, are wherein said trimming of the fuses of the first resistor circuit and the second resistor circuit causes a combined resistance of the first resistor circuit and the second resistor circuit to be $K\times(2^n-1)$, where n is the number of resistors in the first resistor circuit and the second resistor circuit.

8. The trimming method as claimed in claim 7, wherein the fuses of the first resistor circuit and the fuses of the second resistor circuit are subjected to the trimming so that first binary number data of the first resistor circuit and second binary number data of the second resistor circuit are complements of each other, the first binary number data being obtained by expressing with binary data whether each of the fuses of the first resistor circuit is to be cut by the trimming and the second binary number data being obtained by expressing with binary data whether each of the fuses of the second resistor circuit is to be cut by the trimming.

* * * * *